US010113378B2

(12) United States Patent
Skinner

(10) Patent No.: US 10,113,378 B2
(45) Date of Patent: Oct. 30, 2018

(54) SYSTEM AND METHOD FOR MANAGING PRESSURE WHEN DRILLING

(71) Applicant: Halliburton Energy Services, Inc., Houston, TX (US)

(72) Inventor: Neal Gregory Skinner, Denton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 645 days.

(21) Appl. No.: 14/647,839

(22) PCT Filed: Dec. 28, 2012

(86) PCT No.: PCT/US2012/071996

§ 371 (c)(1),
(2) Date: May 28, 2015

(87) PCT Pub. No.: WO2014/105043

PCT Pub. Date: Jul. 3, 2014

(65) Prior Publication Data

US 2015/0300110 A1 Oct. 22, 2015

(51) Int. Cl.

| | |
|---|---|
| ***E21B 21/08*** | (2006.01) |
| ***E21B 33/08*** | (2006.01) |
| ***E21B 21/00*** | (2006.01) |
| ***E21B 33/035*** | (2006.01) |

(52) U.S. Cl.

CPC ..... *E21B 21/08* (2013.01); *E21B 21/001* (2013.01); *E21B 33/035* (2013.01); *E21B 33/085* (2013.01); *E21B 2021/006* (2013.01)

(58) Field of Classification Search

CPC ..... E21B 21/08

See application file for complete search history.

(56) References Cited

U.S. PATENT DOCUMENTS

| | | | |
|---|---|---|---|
| 3,621,912 | A | 11/1971 | Wooddy, Jr. et al. |
| 6,230,824 | B1 | 5/2001 | Peterman et al. |
| 6,263,982 | B1 | 7/2001 | Hannegan et al. |
| 6,470,975 | B1 | 10/2002 | Bourgoyne et al. |

(Continued)

FOREIGN PATENT DOCUMENTS

| | | |
|---|---|---|
| CN | 1737327 | 2/2006 |
| CN | 202325373 | 7/2012 |

(Continued)

OTHER PUBLICATIONS

International Preliminary Report on Patentability, Application No. PCT/US2012/071996, 5 pages, dated Jun. 30, 2015.

(Continued)

*Primary Examiner* — Matthew R Buck
*Assistant Examiner* — Aaron L Lembo
(74) *Attorney, Agent, or Firm* — Baker Botts L.L.P.

(57) ABSTRACT

A pressure management device of a drilling system is disclosed. The device includes a housing, a primary bearing package coupled to the housing such that the primary bearing package is not removable from the housing. The primary bearing package is further configured to rotate with respect to the housing. The device also includes a sealing package configured to automatically seal between a drill pipe and the primary bearing package in response to an insertion of the drill pipe through the housing.

18 Claims, 3 Drawing Sheets

(56) References Cited

U.S. PATENT DOCUMENTS

| | | | | |
|---|---|---|---|---|
| 6,547,002 | B1 | 4/2003 | Bailey et al. | |
| 6,913,092 | B2 | 7/2005 | Bourgoyne et al. | |
| 7,159,669 | B2 | 1/2007 | Bourgoyne et al. | |
| 7,237,623 | B2 | 7/2007 | Hannegan | |
| 7,258,171 | B2 | 8/2007 | Bourgoyne et al. | |
| 7,448,454 | B2 | 11/2008 | Bourgoyne et al. | |
| 7,487,837 | B2 | 2/2009 | Bailey et al. | |
| 7,699,109 | B2 | 4/2010 | May et al. | |
| 7,926,593 | B2 | 4/2011 | Bailey et al. | |
| 7,997,345 | B2 | 8/2011 | Hannegan | |
| 8,028,750 | B2 | 10/2011 | Hughes et al. | |
| 8,347,983 | B2 * | 1/2013 | Hoyer | E21B 21/00 175/22 |
| 8,820,747 | B2 * | 9/2014 | Zubia | E21B 33/085 277/322 |
| 2006/0037744 | A1 | 2/2006 | Hughes | |
| 2008/0105434 | A1 | 5/2008 | Orbell et al. | |
| 2008/0105462 | A1 | 5/2008 | May et al. | |
| 2009/0101351 | A1 | 4/2009 | Hannegan | |
| 2009/0236144 | A1 | 9/2009 | Todd et al. | |
| 2010/0175882 | A1 | 7/2010 | Bailey et al. | |
| 2011/0024195 | A1 * | 2/2011 | Hoyer | E21B 21/00 175/65 |
| 2011/0127040 | A1 | 6/2011 | Humphreys | |
| 2011/0168392 | A1 | 7/2011 | Bailey et al. | |
| 2012/0043726 | A1 * | 2/2012 | Zubia | E21B 33/085 277/322 |
| 2012/0292054 | A1 * | 11/2012 | Orbell | E21B 17/085 166/387 |
| 2015/0376972 | A1 * | 12/2015 | Lock | E21B 33/085 166/250.08 |

FOREIGN PATENT DOCUMENTS

| | | | |
|---|---|---|---|
| EA | 021396 | 6/2015 | |
| EP | 1274920 | 1/2003 | |
| EP | 1519003 | 3/2005 | |
| SU | 1113513 | 9/1984 | |
| WO | 2008/120025 A2 | 2/2013 | A61K 31/535 |

OTHER PUBLICATIONS

Office Action, Australian Application No. 2012397843, 2 pages, dated Dec. 22, 2015.
Office Action, Russian Application No. 2015119879; with machine translation; 4 pages, dated Aug. 27, 2015.
International Search Report and Written Opinion, Application No. PCT/US2012/071996, 7 pages, dated Feb. 25, 2013.
Canadian Office Action, Application No. 2893081; 4 pages, dated Apr. 26, 2016.
Office Action received for Russian Application No. 2015119879, with English translation, dated Jun. 3, 2016.
Extended European Search Report received for European Application No. 12890650.0, dated Jul. 20, 2016; 8 pages.
Office Action received for Chinese Application No. 201280077263.1, with English translation, dated Aug. 17, 2016; 22 pages.

* cited by examiner

SYSTEM AND METHOD FOR MANAGING PRESSURE WHEN DRILLING

RELATED APPLICATION

This application is a U.S. National Stage Application of International Application No. PCT/US2012/071996 filed Dec. 28, 2012, which designates the United States, and which is incorporated herein by reference in its entirety.

TECHNICAL FIELD

The present disclosure generally relates to oilfield drilling equipment and, in particular, to an apparatus and method for managing pressure when drilling.

BACKGROUND

Conventional offshore drilling techniques control pressure inside the wellbore by utilizing the hydrostatic pressure generated by drilling fluid circulated through the well. When using only hydrostatic pressure to control wellbore pressure, it can be difficult to compensate for pressure changes because pressure in the wellbore may be adjusted only by changing the density or specific gravity of the drilling fluid, or by adjusting the mud pump circulation rate. But these methods are incapable of addressing sudden unexpected changes in pressure, as circulation rate induced pressure changes are small, and it can take hours to change the makeup of the drilling fluid. Newer techniques, such as underbalanced drilling and managed pressure drilling, address this problem by closing the annulus and utilizing pressure management devices to control wellbore pressure.

BRIEF DESCRIPTION OF THE DRAWINGS

Some specific exemplary embodiments of the disclosure may be understood by referring, in part, to the following description and the accompanying drawings.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to systems and methods for managing pressure while drilling by using a pressure management device, as described herein. Pressure management devices, also known or variously termed as rotating control devices, rotating control heads, pressure control heads, rotating drilling device, rotating drilling head, rotating annular and other similar terms, may contain a primary bearing package and a sealing package, which permit the pressure management device to seal around a rotating drill pipe and maintain pressure in the annulus (the area between the outside of the drill pipe and the inside of the riser and/or casing and/or open hole). If and when the primary bearing package malfunctions and/or the sealing package begins to leak, it may be necessary to remove all or part of the pressure management device in order to repair and/or replace either the primary bearing package or the sealing package.

Figure 1:
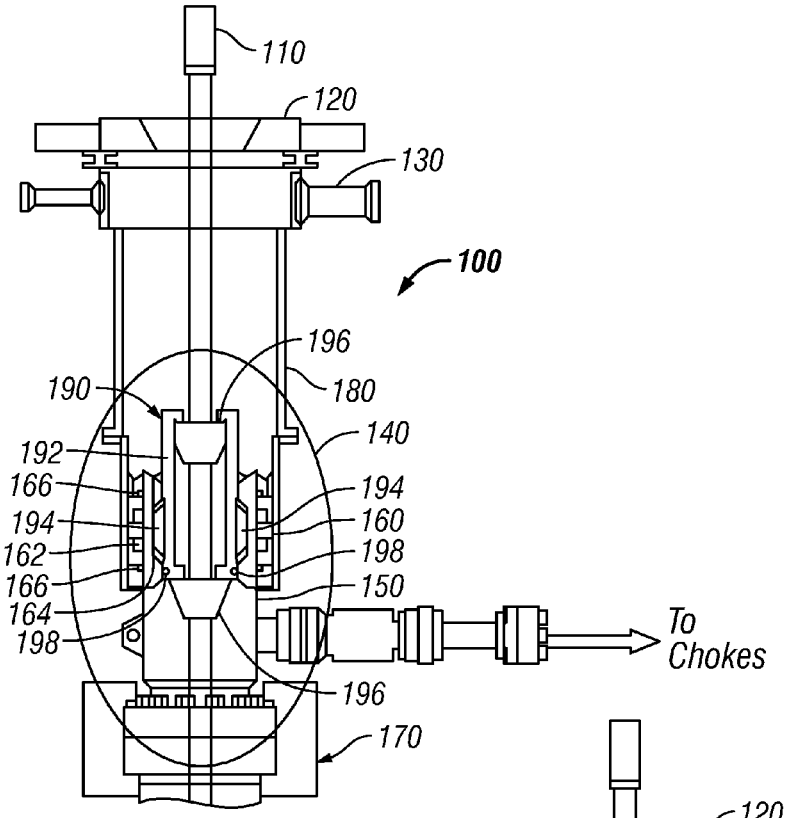
FIG. 1 is a schematic diagram of an offshore drilling fluid return system including a pressure management device, in accordance with one embodiment of the present disclosure.

The systems and methods of this disclosure may be utilized to avoid the time consuming removal of the pressure management device during drilling operations. FIG. 1 illustrates an offshore drilling fluid return system 100 including a pressure management device 140. System 100 may include a drill pipe 110, a rotary table 120, a diverter assembly 130, a pressure management device 140, a quick release clamp 170, and a receiver or tie back mandrel 180. Drill pipe 110 may be part of a drill string associated with a drill bit that may be used to form a wide variety of wellbores or bore holes. The drill string may include additional components including, but not limited to, drill bits, drill collars, rotary steering tools, directional drilling tools, downhole drilling motors, reamers, hole enlargers, or stabilizers. Drill pipe 110 may be coupled to rotary table 120 and rotate with the rotary table 120, such that the rotary table 120 may be used to drive drill pipe 110 and the other components of the drill string. Alternatively, drill pipe 110 may be coupled to a top drive or other system similarly used to rotate the drill pipe 110.

Pressure management device 140 may include a housing 150, a primary bearing package 160, and a removable sealing package 190. Pressure management device 140 may be configured to control the pressure inside the wellbore and/or riser by preventing the circulation of drilling fluid uphole of pressure management device 140. Thus, instead of circulating drill fluid returns uphole of pressure management device and exiting the system through diverter assembly or bell nipple 130, the drilling fluid returns may be circulated through a choke valve, which may increase or decrease the pressure of the drilling fluid, and thus the pressure exerted on the wellbore. At its downhole end, housing 150 may be coupled via a flange or quick release clamp 170 to a riser pipe or a component of a riser assembly. At its uphole end, housing 150 may be coupled via a companion flange, clamp or other similar mating device to receiver or tie back mandrel 180 to a riser pipe or a component of a riser assembly.

Primary bearing package 160 may be coupled to housing 150 in a manner that prevents drilling fluid from flowing between housing 150 and primary bearing package 160. Primary bearing package 160 may include a bearing assembly 162, inner sleeve 164, and seals 166. To permit the removal of drill pipe 110 and/or other components of the drill string without removing primary bearing package 160, the inner diameter of inner sleeve 164 may be sized such that drill pipe 110 and drill string components can pass freely through inner sleeve 164.

Bearing assembly 162 may be configured to permit inner sleeve 164 to rotate with respect to housing 150. Bearing assembly 162 may be any type of bearing capable of supporting rotational and thrust loads. For example, bearing assembly 162 may include roller bearings, ball bearings, journal bearings, tilt-pad bearings, and/or diamond bearings. Seals 166 may isolate bearing assembly 162 from the drilling fluids circulating in the annulus. Seals 166 may be o-ring or other rotating type seals located along the uphole and downhole circumference of bearing assembly 162. Seals 166 may be rubber, nitrile, urethane, or any other similar elastomeric material.

Removable sealing package 190 may include a housing 192, latching elements 194, seal elements 196, and seals 198. Removable sealing package 190 may be configured to seal the annulus and thus substantially prevent the circulation of drilling fluid uphole of pressure management device 140. Removable sealing package 190 may encompass drill pipe 110 such that at least a portion of housing 192 is adjacent inner sleeve 164. Vertical movement of removable sealing package 190 may be prevented by latching elements 194, which may extend radially from housing 192 to engage a latching indentation, formation, or shoulder on inner sleeve 164. Latching element 194 also centers the removable sealing package 190 with respect to the inner sleeve 164. When latching elements 194 are engaged, rotation of drill pipe 110 may induce rotation of removable sealing package 190 and primary bearing package 160. Latching elements 194 may be hydraulically, pneumatically, mechanically, or electrically actuated such that removable sealing package 190 may be easily engaged and disengaged from primary bearing package 160.

Seal elements 196 may be cone-shaped elements configured to encompass drill pipe 110 and automatically seal between drill pipe 110 and housing 192 when a drill pipe 110 is inserted through housing 150. Removable sealing package 190 may contain two seal elements 196, one uphole from the other. Removable sealing package 190 may, however, function with a single seal element 196 installed at either end of removable sealing package 190. Seal 198 may be an o-ring type seal located along the circumference of housing 192 and configured to seal between housing 192 and inner sleeve 164. Seal elements 196 and seal 198 may be rubber, nitrile, urethane, or any other similar elastomeric material.

Figure 2:
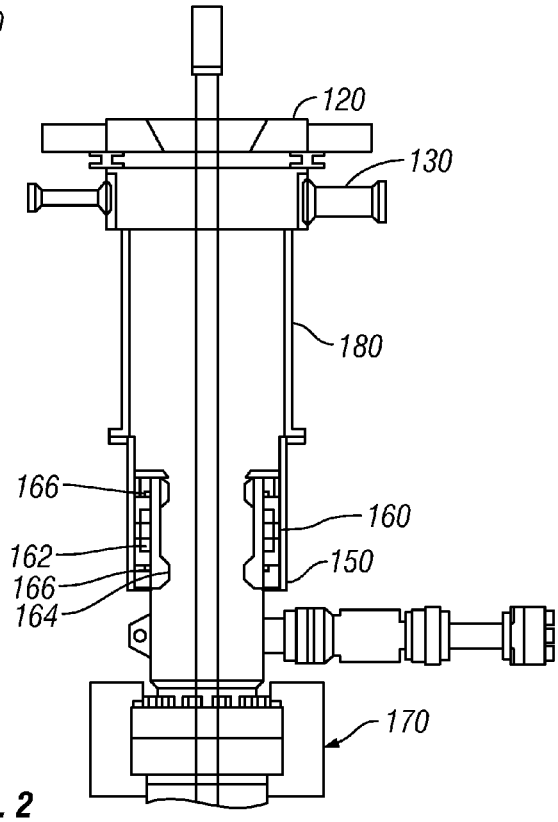
FIG. 2 is a schematic diagram of an offshore drilling fluid return system including a pressure management device, in accordance with another embodiment of the present disclosure.

Removable sealing package 190 may have a limited operable life (e.g., 100-200 drilling hours) before it begins to leak or otherwise malfunction. In the event of a leak and/or malfunction, removable sealing package 190 may be removed from pressure management device 140 by actuating latching elements 194 such that they no longer engage the latching indentation, formation, or shoulder on inner sleeve 164. Once disengaged, removable sealing package 190 may be removed from the wellbore and replaced with an operable sealing package. FIG. 2 illustrates a pressure management device in which sealing package 190 has been removed.

Removable sealing package 190 may also be removed from the wellbore if primary bearing package 160 fails. If primary bearing package 160 fails, removable sealing package 190 may be removed from the wellbore and a secondary bearing package 310 (shown in FIGS. 3 and 4) may be installed uphole from and adjacent to primary bearing package 160. Secondary bearing package 310 may be installed without removing primary bearing package 160 and/or pressure management device 140. Following the failure of primary bearing package 160, secondary bearing package 310 and removable sealing package 190 may be installed as a single unit (e.g., secondary bearing package 310 may be installed with removable sealing package 190 already engaged) or they may be installed separately.

Figure 3:
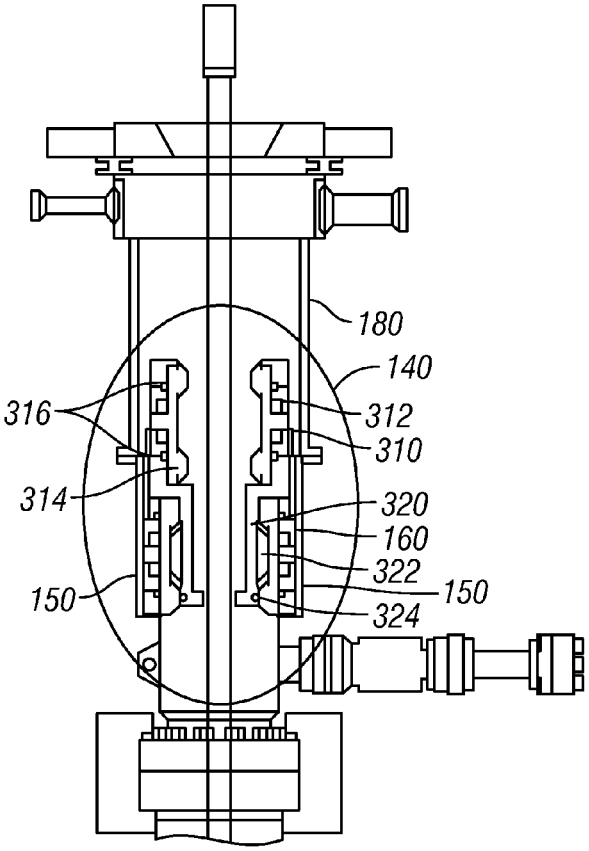
FIG. 3 is a schematic diagram of an offshore drilling fluid return system including a pressure management device, in accordance with another embodiment of the present disclosure.
Figure 4:
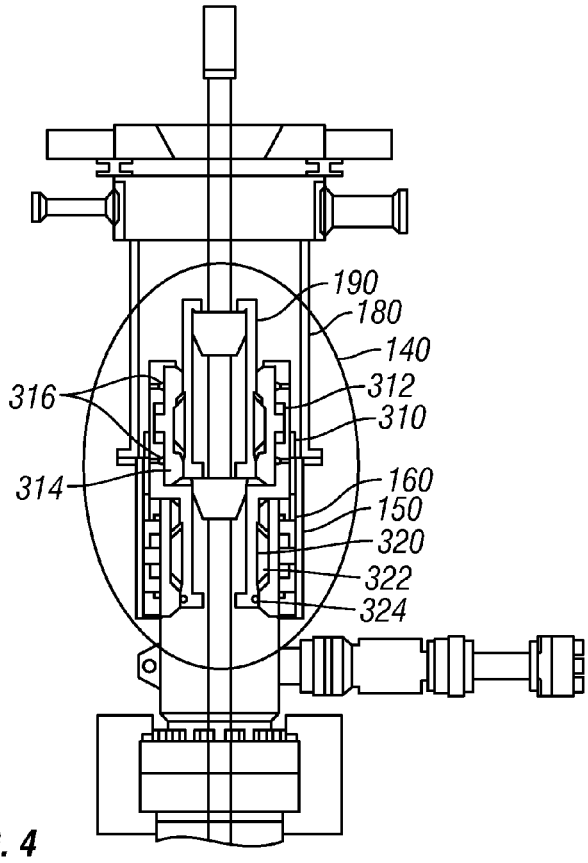
FIG. 4 is a schematic diagram of an offshore drilling fluid return system including a pressure management device, in accordance with another embodiment of the present disclosure.

FIG. 3 illustrates an offshore drilling fluid return system 300 in which a secondary bearing package 310 has been installed separeately from a removable sealing package 190. As shown in FIG. 3, secondary bearing package 310 may be installed uphole from primary bearing package 160 without removing primary bearing package 160. Secondary bearing package 310 may include a bearing assembly 312, an inner sleeve 314, seals 316, and engagement assembly 320, which may include latching elements 322 and seal 324.

Bearing assembly 312 may be configured to permit inner sleeve 314 to rotate with respect to housing 150. Bearing assembly 312 may be any type of bearing capable of supporting rotational and thrust loads. For example, bearing assembly 312 may include roller bearings, ball bearings, journal bearings, tilt-pad bearings, and/or diamond bearings. Seals 316 may isolate bearing assembly 312 from the drilling fluids circulating in the annulus. Seals 316 may be o-ring type seals located along the uphole and downhole circumference of bearing assembly 312. Seals 316 may be rubber, nitrile, urethane, or any other similar elastomeric material.

Engagement assembly 320 may be configured to extend into primary bearing package 160, as shown in FIG. 3. Latching elements 322 may extend radially from engagement assembly 320 to engage the latching indentation, formation, or shoulder on inner sleeve 164 of primary bearing package 164. Like latching elements 194 of removable sealing package 190, latching elements 322 may be hydraulically, pneumatically, mechanically, or electrically actuated such that secondary bearing package 310 may be easily engaged with primary bearing package 160. Seal 324 may be an o-ring type seal located along the circumference of engagement assembly 320 and configured to provide a seal between engagement assembly 320 of secondary bearing package 310 and inner sleeve 164 of primary bearing package 160. Seal 324 may be rubber, nitrile, urethane, or any other similar elastomeric material.

Although FIGS. 1-3 illustrate only a primary bearing package 160 and a secondary bearing package 310, additional bearing packages may be installed provided that housing 150 has sufficient space. For example, a tertiary bearing package may be installed uphole from secondary bearing package 310 without removing primary bearing package 160 or secondary bearing package 310. Additional bearing packages may be stacked in this manner so long as there is space in housing 150.

As discussed above, FIG. 4 illustrates a removable sealing package 190 engaged with secondary bearing package 310. As discussed above, secondary bearing package 310 and removable sealing package 190 may be installed as a single unit or they may be installed separately. When removable sealing package 190 is engaged with secondary bearing package 310, vertical movement of removable sealing package 190 may be prevented by latching elements 194, which may extend radially from housing 192 to engage a latching indentation, formation, or shoulder on inner sleeve 314 of secondary bearing package 310. When latching elements 194 are engaged, rotation of drill pipe 110 may induce rotation of removable sealing package 190 and secondary bearing package 310. When removable sealing package 190 is installed in conjunction with secondary bearing package 310, downhole seal element 196 may seal with the surface of engagement assembly 320, thereby substantially preventing circulation of drilling fluids uphole from pressure management device 140.

Figure 5:
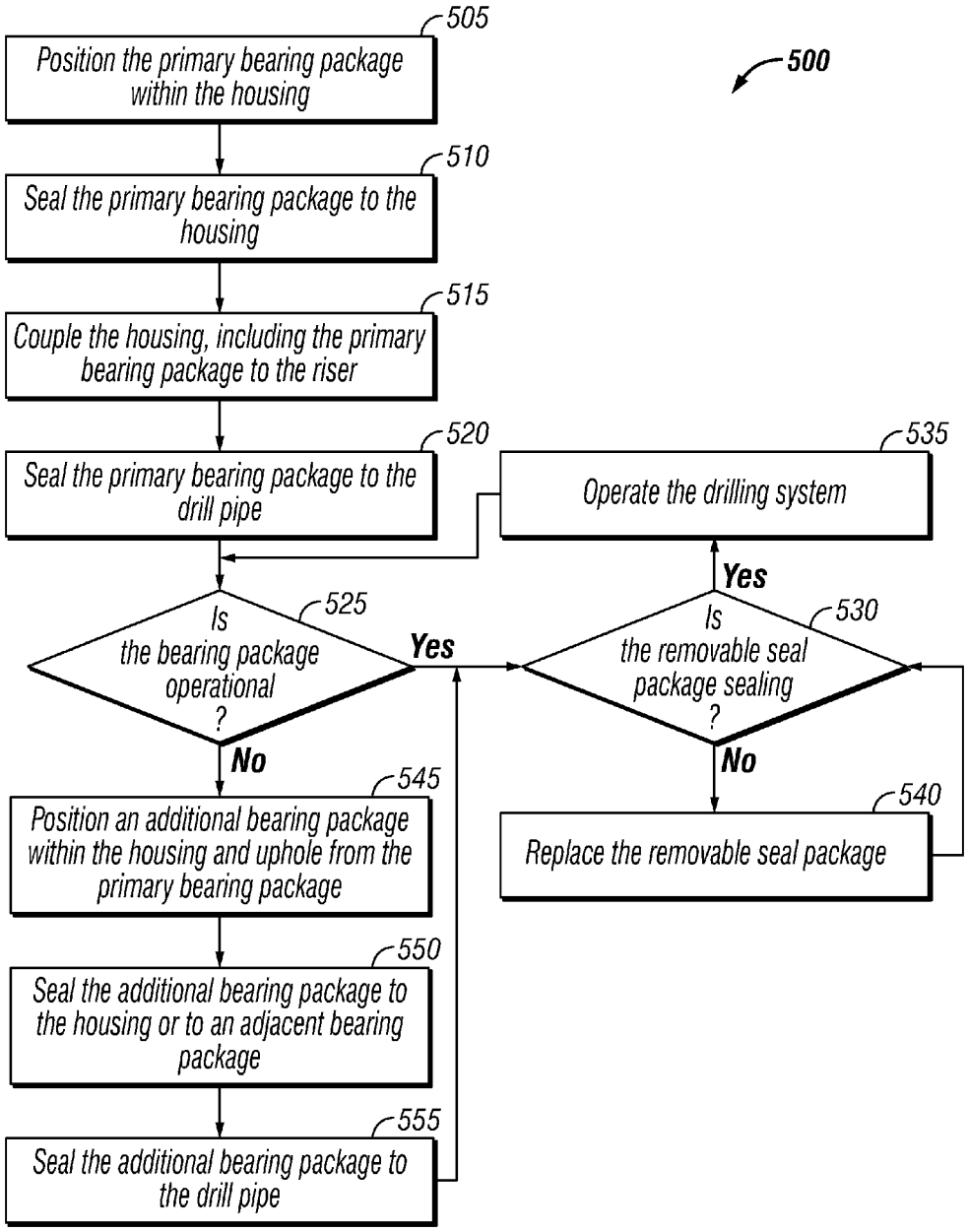
FIG. 5 is a flowchart of an example method of managing pressure in a drilling system, in accordance with the present disclosure.

FIG. 5 illustrates an example method 500 of managing pressure in a drilling system using a pressure management device in accordance with the present disclosure. At 505, primary bearing package may be positioned within and coupled to the housing of the pressure management device. At step 510, primary bearing package may be sealed to the housing of the pressure management device. At step 515, the downhole end of the housing of the pressure management device may be coupled via a flange or quick connect clamp to a riser or a component of a riser assembly.

At step 520, the primary bearing package may be sealed to the drill pipe. As discussed above, the primary bearing package may be sealed to the drill pipe via a removable sealing package, which may engage with the primary bearing package to seal the annulus, thereby substantially preventing the circulation of drilling fluid returns uphole of the pressure management device. At step 525, a determination may be made as to whether the primary bearing package is sealing. If the primary bearing package is operational, the method may proceed to step 530.

At step 530, a determination may be made regarding whether the removable sealing package is maintaining a seal between the primary bearing package and the drill pipe. If so, the method may proceed to step 535. If it is determined that the removable sealing package is not maintaining a seal between the primary bearing package and the drill pipe, the method may proceed to step 540. At step 540, the removable sealing package may be removed from the pressure management device and replaced. Following replacement of the removable sealing package, the method may again proceed to step 530. If the replacement sealing package is sealing, the method may proceed to step 535. At step 535, the drilling system may be operated and the pressure in the wellbore may be managed using the pressure management device.

If, at step 525, it is determined that the primary bearing package has become non-operational, the method may proceed to step 545. At step 545, an additional bearing package may be positioned uphole from the primary bearing package within the housing of the pressure management device. As discussed above, if the primary bearing package fails, the removable sealing package may be removed from the wellbore and an additional bearing package may be installed uphole from and adjacent to the primary bearing package. The additional bearing package may engage the primary bearing package via an engagement assembly, thereby substantially preventing vertical movement of the additional bearing package.

At step 550, the additional bearing package may be sealed to the primary bearing package or the housing of the pressure management device. The additional bearing package may be sealed to the primary bearing package using an o-ring type seal located along the circumference of the engagement assembly of the additional bearing package and configured to provide a seal between the engagement assembly of the secondary bearing package and an inner sleeve of the primary bearing package. Alternatively, or additionally, an additional bearing package may include an o-ring type seal located along its uphole circumference, which may be configured to provide a seal between the additional bearing package and the housing of the pressure management device.

At step 555, the additional bearing package may be sealed to the drill pipe. The additional bearing package may be sealed to the drill pipe via a removable sealing package. The removable sealing package may be installed in conjunction with the additional bearing package or may be installed separately. When the removable sealing package is engaged with the additional bearing package, a downhole seal element may seal with the surface of the engagement assembly of the additional bearing package, thereby substantially preventing circulation of drilling fluid returns uphole from the pressure management device.

Following the installation and sealing of the additional bearing package, the method may proceed to step 530, where a determination may be made regarding whether the removable sealing package is maintaining a seal between the bearing package and the drill pipe. If the removable sealing package is sealing, the method may proceed to step 535. At step 535, the drilling system may be operated and the pressure in the wellbore may be managed using the pressure management device.

If the removable sealing package is not maintaining a seal between the additional bearing package and the drill pipe, the method may proceed to step 540. At step 540, the removable sealing package may be removed from the pressure management device and replaced. Following replacement of the removable sealing package, the method may proceed to step 535. At step 535, the drilling system may be operated and the pressure in the wellbore may be managed using the pressure management device.

Periodically during operation of the drilling system, the method may return to step 525 to determine whether the bearing package remains operational. If a determination is made that a bearing package is not operational, the method may proceed by installing and sealing an additional bearing packages without removing those already installed, as discussed in relation to method steps 545 through 555. Additional bearing packages may be stacked in this manner so long as there is space in the housing of the pressure management device.

Although the present disclosure has been described in detail, it should be understood that various changes, substitutions, and alterations can be made hereto without departing from the spirit and the scope of the disclosure as defined by the appended claims.

What is claimed is:

1. A pressure management device of a drilling system comprising:

a housing;

a primary bearing package coupled to the housing such that the primary bearing package is not removable from the housing and configured to rotate with respect to the housing;

a secondary bearing package uphole from the primary bearing package, the secondary bearing package configured to rotate with respect to the housing and be installed without removing the primary bearing package, the secondary bearing package including an engagement assembly extending into the primary bearing package; and a sealing package configured to automatically seal between a drill pipe and the secondary bearing package in response to an insertion of the drill pipe through the housing.

2. The pressure management device of claim 1, wherein the primary bearing package comprises:

a bearing assembly;

an inner sleeve; and a bearing seal, wherein the bearing seal is configured to substantially isolate the bearing assembly from a drilling fluid circulating in the drilling system.

3. The pressure management device of claim 1, wherein the secondary bearing package further comprises:

a bearing assembly;

an inner sleeve;

a bearing seal, wherein the bearing seal is configured to substantially isolate the bearing assembly from a drilling fluid circulating in the drilling system; and the engagement assembly includes a latching element and an engagement seal, the latching element configured to substantially prevent uphole movement of the secondary bearing package by engaging the primary bearing package, the engagement seal configured to sealably engage an inner sleeve of the primary bearing package.

4. The pressure management device of claim 3, wherein the latching element is configured to be electrically, mechanically, pneumatically or hydraulically engaged and disengaged.

5. The pressure management device of claim 1, wherein the sealing package comprises:

a sealing package housing;

a latching element, the latching element configured to substantially prevent uphole movement of the sealing package;

a seal element, the seal element configured to seal between the drill pipe and the sealing package housing; and a seal, the seal located along the circumference of the sealing package housing.

6. The pressure management device of claim 5, wherein the seal is configured to be electrically, mechanically, pneumatically or hydraulically engaged and disengaged.

7. A drilling fluid return system comprising:

a riser;

a drill pipe; and a pressure management device mounted in the riser, the pressure management device including:

a housing;

a primary bearing package coupled to the housing such that the primary bearing package is not removable from the housing and configured to rotate with respect to the housing;

a secondary bearing package uphole from the primary bearing package, the secondary bearing package configured to rotate with respect to the housing and be installed without removing the primary bearing package, the secondary bearing package including an engagement assembly extending into the primary bearing package; and a sealing package configured to automatically seal between the drill pipe and the secondary bearing package in response to the insertion of the drill pipe through the housing.

8. The system of claim 7, wherein the primary bearing package comprises:

a bearing assembly;

an inner sleeve; and a bearing seal, wherein the bearing seal is configured to substantially isolate the bearing assembly from a drilling fluid circulating in the drilling system.

9. The system of claim 7, wherein the secondary bearing package further comprises:

a bearing assembly;

an inner sleeve;

a bearing seal, wherein the bearing seal is configured to substantially isolate the bearing assembly from a drilling fluid circulating in the drilling system; and the engagement assembly includes a latching element and an engagement seal, the latching element configured to substantially prevent uphole movement of the secondary bearing package by engaging the primary bearing package, the engagement seal configured to sealably engage an inner sleeve of the primary bearing package.

10. The pressure management device of claim 9, wherein the latching element is configured to be electrically, mechanically, pneumatically or hydraulically engaged and disengaged.

11. The pressure management device of claim 7, wherein the sealing package comprises:

a sealing package housing;

a latching element, the latching element configured to substantially prevent uphole movement of the sealing package;

a seal element, the seal element configured to seal between the drill pipe and the sealing package housing; and a seal, the seal located along the circumference of the sealing package housing.

12. The pressure management device of claim 11, wherein the latching element is configured to be electrically, mechanically, pneumatically or hydraulically engaged and disengaged.

13. A method of managing pressure in a drilling system comprising:

positioning a primary bearing package within a housing, wherein the primary bearing package is configured to rotate relative to the housing;

sealing the primary bearing package to the housing;

fixedly coupling the housing to a riser;

sealing the primary bearing package to a drill pipe; and in response to a failure of the primary bearing package, positioning a secondary bearing package within the housing uphole from the primary bearing package without removing the primary bearing package from the housing, sealing the secondary bearing package to the primary bearing package or the housing, and sealing the secondary bearing package to the drill pipe.

14. The method of claim 13, wherein sealing the primary bearing package to the drill pipe comprises:

positioning a sealing package between the primary bearing package and the drill pipe;

sealing the sealing package to the primary bearing package; and sealing the sealing package to the drill pipe.

15. The method of claim 14, wherein positioning the sealing package comprises engaging a latching element of the sealing package with the primary bearing package.

16. The method of claim 14, wherein the sealing package comprises:

a sealing package housing;

a seal configured to seal between the housing and the primary bearing package; and a seal element configured to seal between the sealing package housing and the drill pipe.

17. The method of claim 13, wherein sealing the secondary bearing package to the drill pipe comprises:

positioning a sealing package between the secondary bearing package and the drill pipe;

sealing the sealing package to the secondary bearing package; and sealing the sealing package to the drill pipe.

18. The method of claim 13, wherein positioning the secondary bearing package comprises engaging a latching element of the secondary bearing package with the primary bearing package.

* * * * *